US005799956A

United States Patent [19]

Shannon

[11] Patent Number: 5,799,956

[45] Date of Patent: Sep. 1, 1998

[54] TWO-PIECE APPARATUS FOR SLIDING ON A SURFACE

[75] Inventor: Walter D. Shannon, Tacoma, Wash.

[73] Assignee: Axxis Sport, Inc., Seattle, Wash.

[21] Appl. No.: 613,436

[22] Filed: Mar. 4, 1996

Related U.S. Application Data

[63] Continuation-in-part of Ser. No. 611,445, Mar. 1, 1996, abandoned.

[51] Int. Cl.[6] ..... A63C 5/03

[52] U.S. Cl. ..... 280/14.2; 280/16; 280/21.1; 280/22.1; 280/606; 280/845

[58] Field of Search ..... 280/14.2, 16, 15, 280/845, 21.1, 22.1, 606

[56] References Cited

U.S. PATENT DOCUMENTS

| | | | |
|---|---|---|---|
| 2,442,918 | 6/1948 | Caughrean . | |
| 2,592,116 | 4/1952 | Caughrean . | |
| 3,190,671 | 6/1965 | Fabris | 280/22.1 |
| 4,138,128 | 2/1979 | Criss . | |
| 4,163,565 | 8/1979 | Weber . | |
| 4,175,759 | 11/1979 | Strunk . | |
| 4,194,753 | 3/1980 | Schrishuhn, Jr. . | |
| 4,221,394 | 9/1980 | Campbell . | |
| 4,652,007 | 3/1987 | Dennis . | |
| 4,725,069 | 2/1988 | Stampacchia et al. . | |
| 4,784,233 | 11/1988 | Favors | 280/16 |
| 4,979,760 | 12/1990 | Derrah . | |
| 5,021,017 | 6/1991 | Ott . | |
| 5,028,068 | 7/1991 | Donovan . | |
| 5,249,816 | 10/1993 | Southworth . | |
| 5,411,282 | 5/1995 | Shannon . | |

*Primary Examiner*—Eric D. Culbreth

*Attorney, Agent, or Firm*—Christensen O'Connor Johnson & Kindness PLLC

[57] ABSTRACT

A two-piece apparatus for sliding over a surface. The device includes forward and rear runners connected by a linkage which allows a user to increase deviation of the runners from a horizontal plane at the same time that a deviation from the longitudinal axis of the apparatus occurs. Thus, the user can tilt or edge the runners at the same time that a turn is being implemented. The board provides a narrower waist section than the leading or trailing sections on each of the forward and rear runners. In addition, at maximum articulation of the runners, a substantially smooth arc is formed along the inner edge of the runners so that optimal cornering and shorter radii may be achieved. Preferably, each of the runners includes a set of fins along a rearward edge so that the device may bite into the surface more aggressively.

13 Claims, 5 Drawing Sheets

TWO-PIECE APPARATUS FOR SLIDING ON A SURFACE

The present application is a continuation-in-part of U.S. application Ser. No. 08/611,445 filed on Mar. 1, 1996 entitled TWO-PIECE APPARATUS FOR SLIDING ON A SURFACE in the name of Walter D. Shannon now abandoned.

FIELD OF THE INVENTION

The present invention relates to a two-piece system for sliding over a surface, and more particularly relates to an apparatus for sliding over snow.

BACKGROUND OF THE INVENTION

The popularity of snowboarding has increased over the last few years, as is evidenced by the large number of snowboarders found at resort areas and on ski slopes. At some locations, special areas and slopes have been specifically dedicated to snowboarders. However, although snowboarders and skiers are often found in the same recreation areas, the two sports require different techniques, and mastery of one of the sports does not necessarily translate to competency in the other. Snowboarding tends to be more like skateboarding and surfing than skiing, and requires much control of the board to attain turns of varying radii and frequency.

The complications involved with controlling and guiding a snowboard are described in detail in U.S. Pat. No. 5,411,282, owned by the present inventor. In that patent, a system is described for guiding a two-piece snowboard over snow to assist a user in turning a snowboard with relative ease. The system includes a linkage which allows a user to increase deviation of the runners from a horizontal plane at the same time that a deviation from the longitudinal axis of the snowboard occurs. Thus, the user can tilt or edge the runners at the same time that a turn is being implemented. In this manner, the system provides the user with the sensation of leaning into the turn as a turn is being carried out. The present invention concerns improvements to the structure and design of the apparatus disclosed in that patent.

SUMMARY OF THE INVENTION

Although the device of U.S. Pat. No. 5,411,282 teaches the principle of front and rear runners articulating with respect to one another to edge in the direction of the turn, the present invention further aids a user on implementation of a turn, and provides a structure that facilitates short radius turns and high frequency edge-to-edge turns by a recreational user. The present invention provides these advantages by utilizing a narrower waist section than the leading or trailing sections on each of the forward and rear runners. The present invention also provides a constant arc on the inside edge of the forward and rear runners extending from the center of the edge of the forward runner to the center of the edge of the rearward runner when the apparatus is in the maximum articulation. In addition, fins are added to the bottom side of the forward runner, as well as the rear runner, to add to stability.

More particularly described is an apparatus for sliding on a surface having a forward runner and a rear runner, the forward and rear runner defining right and left edges, front, rearward, and central sections, upper surface, and an opposing lower surface. The width of the central section is preferably less than the width of both the front section and the rearward section. The apparatus includes a linkage for connecting the forward runner to the rear runner, such that the forward runner and the rear runner lie substantially in a plane and such that the front section of the rear runner is proximal to the rearward section of the forward runner. The linkage is configured such that the linkage maintains a distance between the forward and rear runners, but allows articulation of the two runners relative to one another.

The linkage is configured to define an inside articulation of the forward and rear runners such that the inside angle formed by the longitudinal axis of the front runner and the longitudinal axis of the rear runner is acute. When the apparatus is in this configuration, the rear portion of the left edge of the front runner and the forward portion of the left edge of the rear runner preferably form a substantially smooth arc. It is preferred that the linkage defines a maximum inside articulation of the forward runner relative to the rear runner, and the arc is formed at this maximum inside articulation. For optimal results, the substantially smooth arc extends along the inside edge of the front runner from approximately the central section of the forward runner to the rear section of the forward runner and continues to extend along the inside edge of the rear runner from approximately the front section of the rear runner to the central section of the rear runner.

The present invention also provides an apparatus for sliding on a surface having a forward runner and a rear runner, the apparatus having a fin located on the lower surface of the forward runner and/or a fin on the lower surface of the rear runner. Preferably, there are two fins on the lower surface of the forward runner and/or two fins on the lower surface of the rear runner. The fins may be located on opposite sides of the lower surface of the respective runner in the rear section of the respective runner.

The present invention also provides optimal centering for a user of the apparatus. In this configuration, the linkage is connected to the forward runner at substantially one location, and is connected to the rearward runner at substantially a second location. A midpoint is located between the first location and the second location preferably lies substantially halfway between the forward runner and the rear runner. If this embodiment utilizes the arc features described above, preferably the focus of the arc lies on a line which extends through the midpoint and the intersection of the longitudinal axes of the forward and rear runners at the inside articulation.

Thus, it is an object of the present invention to provide an improved apparatus for sliding over a surface.

It is a further object of the present invention to provide an improved two-piece snowboard.

Another object of the present invention is to provide a two-piece snowboard which teaches a user the sensation of leaning into a turn as the turn is being carried out.

Yet another object of the present invention is to provide a two-piece snowboard which is easier to handle when implementing a turn.

A further object of the present invention is to provide a substantially constant arc along the inner edge of a two-piece snowboard so that the snowboard may more easily implement a turn.

Still another object of the present invention is to provide a substantially constant arc along the inner edge of a two-piece snowboard at maximum articulation of the snowboard.

BRIEF DESCRIPTION OF THE DRAWING

Other objects, features and advantages of the present invention will become apparent upon consideration of the following detailed description of the invention and the appended claims, when taken in conjunction with the accompanying drawings, wherein:

DETAILED DESCRIPTION OF THE PREFERRED EMBODIMENT

Figure 1:
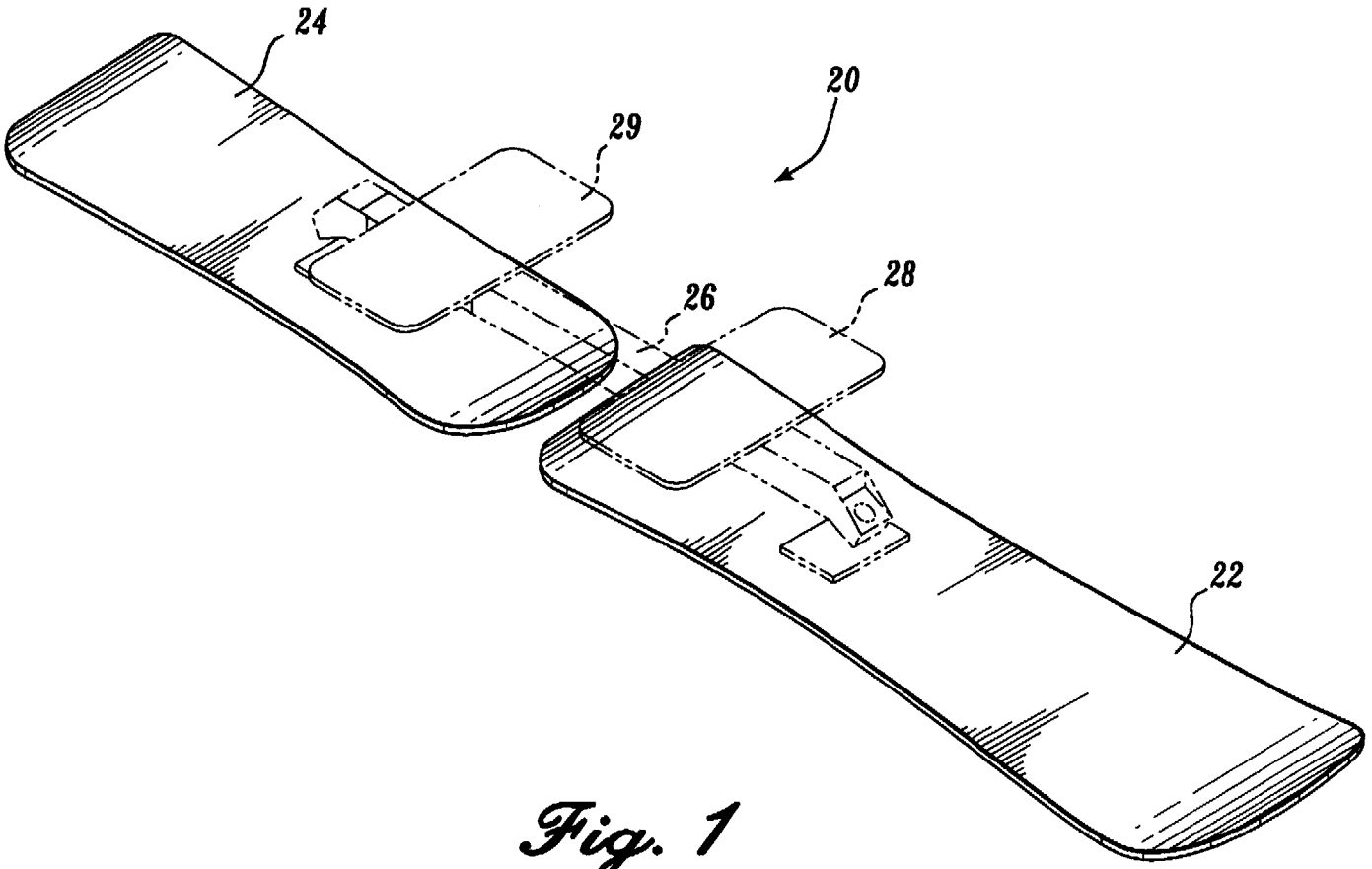
FIG. 1 is a perspective view of a two-piece apparatus for sliding on a surface, more particularly a snowboard, formed in accordance with a preferred embodiment of the present invention.

Referring now to the drawings, in which like reference numerals represent like parts throughout the several views, FIG. 1 displays a two-piece apparatus for sliding on a surface, more specifically a snowboard 20, setting forth a preferred embodiment of the present invention. The snowboard 20 is a two-piece construction, including a forward runner 22 and a rear runner 24 connected by a linkage 26. On the top side of the linkage 26 are two platforms, a forward platform 28 and a rear platform 29. Briefly described, the two-piece snowboard is designed such that a user stands on the two platforms 28, 29 and directs the snowboard 20 down a slope with the rear runner 24 following the forward runner 22. As is described in detail below, the advantages and features described in this invention help the user to more easily direct the snowboard 20 down a hill with optimal stability of the snowboard, as well as aid in steering and turning in a desired fashion. The linkage 26 and the snowboard 20 of the present invention are capable of many of the same functions of the device set forth in U.S. Pat. No. 5,411,282, having the same inventor as the present disclosure, and incorporated herein by reference.

Figure 2:
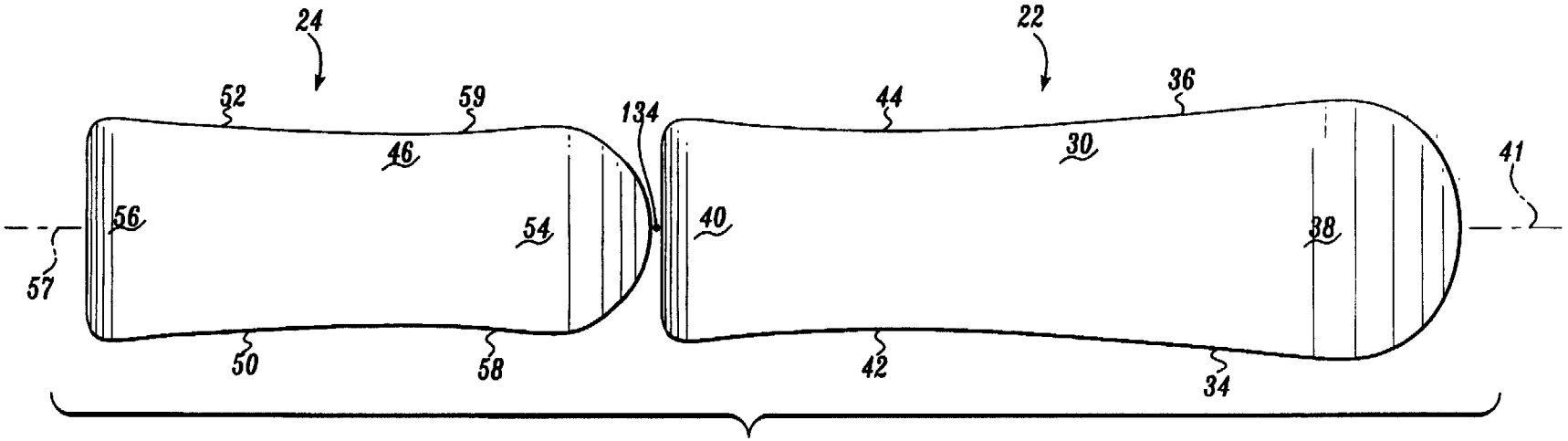
FIG. 2 is a top view of the runners for the two-piece apparatus of FIG. 1, with the linkage removed for detail.

As can best be seen in FIG. 2, the front runner 22 includes an upper surface 30, a lower surface 32 (FIG. 6), a right edge 34, a left edge 36, a front section 38, and a rearward section 40. A longitudinal axis 41 is defined along the length of the forward runner 22. Just behind the middle of the forward runner 22 along the left and right edges 34, 36 are indentations which form waists 42, 44 for the forward runner 22. Similarly, the rear runner 24 includes an upper surface 46, a lower surface 48 (FIG. 6), a right edge 50, a left edge 52, a front section 54, a rearward section 56, longitudinal axis 57, a right waist 58, and a left waist 59. Preferably, the waists 58, 59 located on the rear runner 24 are slightly ahead of the center of the board. The waists 42, 44, 58, 59 located on both the front runner 22 and the rear runner 24 aid in a user's implementation of a turn, as is described in detail below. The location of the respective waists has been described above with respect to a preferred embodiment. It should be understood that the present invention contemplates location of the waists at different locations along the length of the forward and rear runners.

Figure 3:
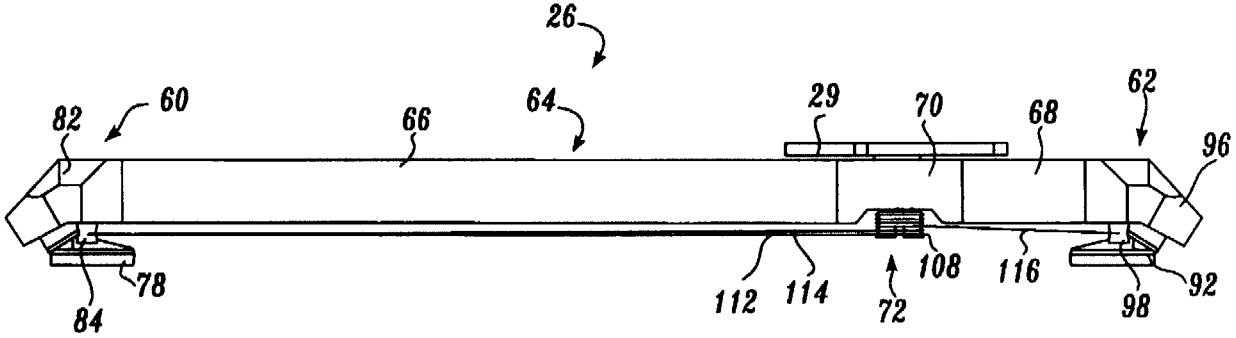
FIG. 3 is a side view of the linkage for the apparatus of FIG. 1, with the forward platform removed for detail.
Figure 4:
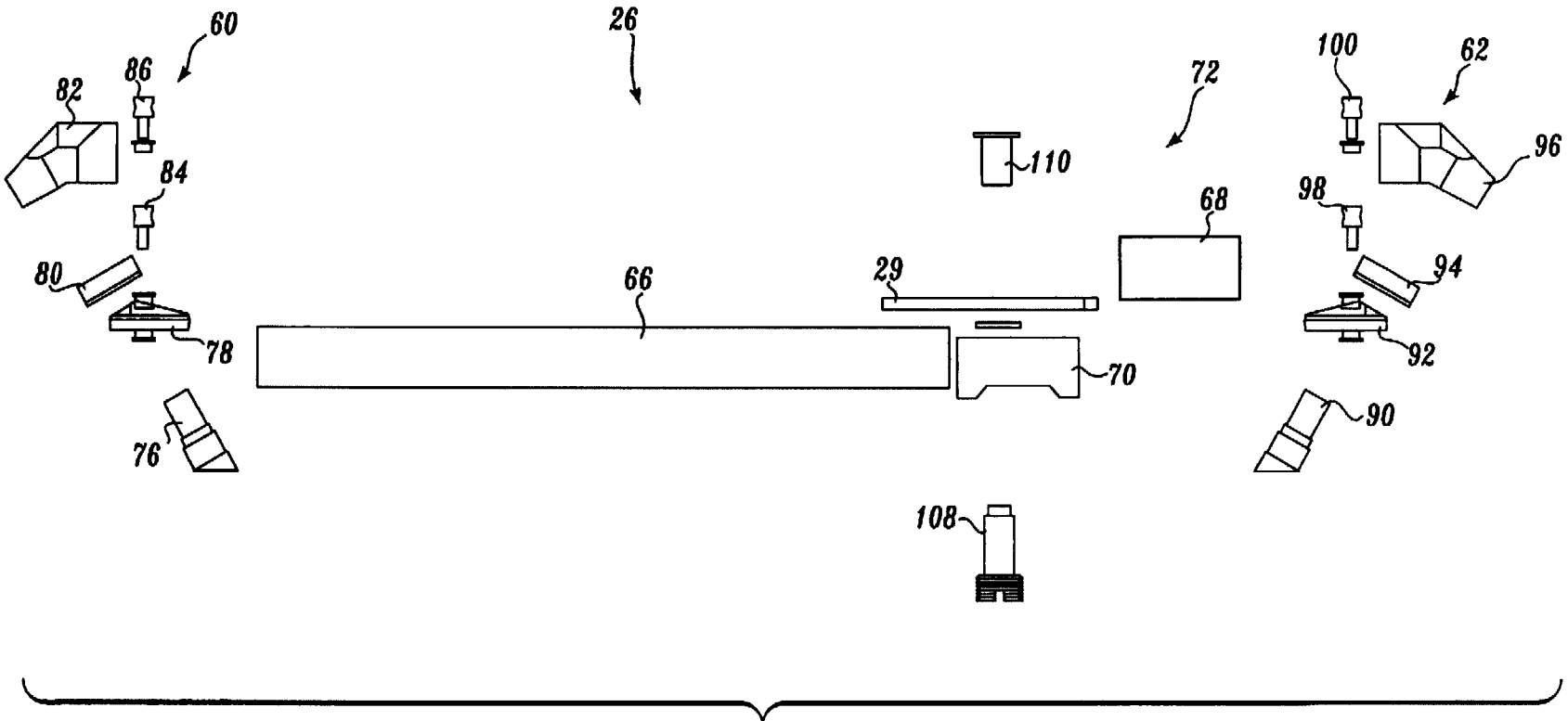
FIG. 4 is an exploded view of the linkage of FIG. 3.
Figure 5:
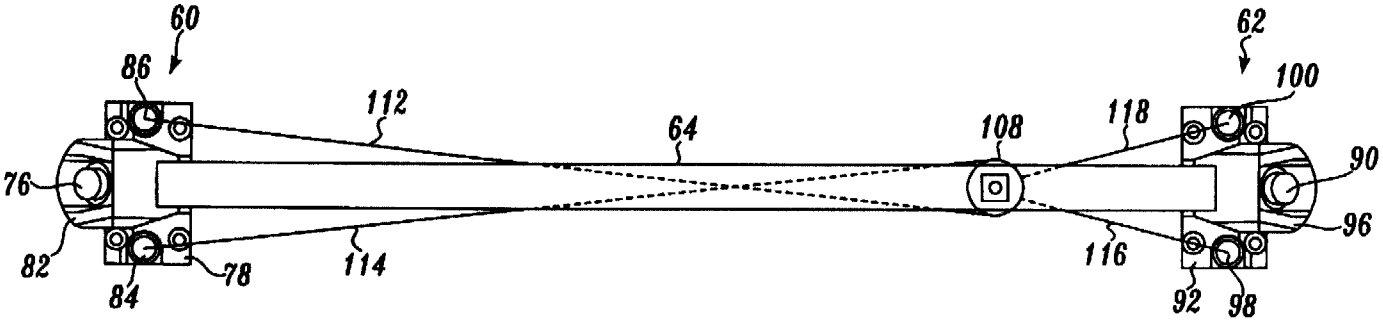
FIG. 5 is a top view of the linkage of FIG. 3, with the front and rear platforms removed for detail.

As can best be seen in FIGS. 3, 4 and 5, the linkage 26 includes a forward shaft assembly 60 and a rear shaft assembly 62. Extending between the forward shaft assembly 60 and the rear shaft assembly 62 is an elongate three-piece beam 64. In the embodiment shown, the elongate three-piece beam 64 includes a forward piece 66 and a rear piece 68 connected by a hollow link 70. The hollow link 70 includes a bore (not shown) extending vertically through its center. The elongate three-piece beam 64 alternatively could be a one-piece construction incorporating a bore at the location of the hollow link piece 70. The hollow link piece 70 is designed to receive a rear lever assembly 72, the function and structure of which will be described in detail below. The rear platform 29 is attached to the top of the rear lever assembly 72. The forward platform 28 is bolted or attached to the forward piece in a conventional manner so that its distance from rear platform 29 can be changed to accommodate different riders.

The forward shaft assembly 60 includes a forward shaft 76 designed to extend upward and in a forward direction. The longitudinal axis of the forward shaft 76 forms an acute angle of approximately 45° to about 85° with the upper surface 30 of the forward runner 22. The lower end of the forward shaft 76 is adapted to be received in a slanted bore (not shown) of a forward lever 78, which is attached to the upper surface 30 of the forward runner 22, using bolts or some other conventional means.

A forward bearing 80 fits on the forward shaft 76 outside the forward lever 78. On top of this bearing 80 sits a cap 82. This cap 82 is adapted to receive the distal end of the forward piece 66 of the elongate three-piece beam 64. The mounting of the forward cap 82 along with the forward bearing 80 is such that the cap is free to turn about the shaft 76. Located at the distal, rearward ends of the forward lever 78 are two cable receptors 84, 86, the function of which will be described in detail below.

The rear shaft assembly 62 is essentially a mirror image of the forward shaft assembly 60, and includes a rear shaft 90, rear lever 92, rear bearing 94, rear cap 96, and rear cable receptors 98, 100. The rear shaft 90 is angled rearward with its longitudinal axis forming an acute angle of approximately 45° to about 85° with the upper surface 46 of the rear runner 24. The rear cap 96 is adapted to receive one end of the rear piece 68 of the elongate three-piece beam 64, and is mounted for rotation about the rear shaft 90.

The rear lever assembly 72 includes a lower cable spool 108 and an upper mounting pin 110, as can be best seen in FIG. 4. The upper mounting pin 110 is configured to fit inside the hollow link 70 of the elongate beam 64 and is adapted to receive the upper portion of the cable spool 108. The mounting pin 110 is fixed to the rear platform 29 such that the rear platform, the mounting pin, and the cable spool 108 may rotate within the hollow link 70.

Referring now to FIG. 5, four cables 112, 114, 116, 118 extend from the cable spool 108 to the cable receptors 84, 86, 98, 100. A first cable 112 extends from the right cable receptor 86 underneath the elongate beam 64 to the far left side of the cable spool 108. Likewise, a second cable 114 extends from the left cable receptor 84 to the far right side of the cable spool 108. As shown in phantom in FIG. 5, the first cable 112 and the second cable 114 cross beneath the three-piece elongate beam 64. Rear cables 116, 118 extend from the cable spool 108 to the rear cable receptors 98, 100. A first rear cable 116 extends from the left side of the cable spool 108 back to the left cable receptor 98. Likewise, a second rear cable 118 extends from the right side of the cable spool 108 back to the right rear cable receptor 100.

As can be understood from the above description, the arrangement of the cables 112, 114, 116, 118 is such that rotation of the rear platform 29 and therefore the rear lever assembly 72 causes an opposite, mirror-like effect on the two shaft assemblies 60, 62. That is, with reference to FIG. 5, when the rear platform 29 rotates clockwise, the forward shaft assembly 60 rotates counterclockwise, and the rear shaft assembly rotates clockwise. Moreover, because the shafts 76, 90 are at an acute angle to the upper surface 30, 46 of the runners 22, 24, the linkage 26 allows a user to increase deviation of the runners 22, 24 from a horizontal plane at the same time that a deviation from the longitudinal axis of the snowboard 20 occurs. Stated another way, a user can tilt or edge the runners 22, 24 at the same time that a turn is being implemented.

The cables 112, 114 preferably extend to the outer edges of the cable spool 108, while the cables 116, 118 extend to a portion of the cable spool 108 inside the attachment location of the cables 112, 114. The distance from the axis of the cable spool to the attachment location of rear cables 116, 118 is preferably approximately one-third the distance from the axis to the attachment location of front cables 112, 114 to spool 108. In this manner, the deviation of the runners 22, 24 from horizontal and from the longitudinal axis of the snowboard 20 is greatest in the front runner 22, which optimizes steering and handling of the snowboard 20. Preferably, the rotation of the rear platform 29 or the rear lever assembly 72 is limited such that the maximum articulation of the longitudinal axis 41 of the forward runner 22 relative to the longitudinal axis 57 of the rear runner 24 is approximately 8°.

Figure 6:
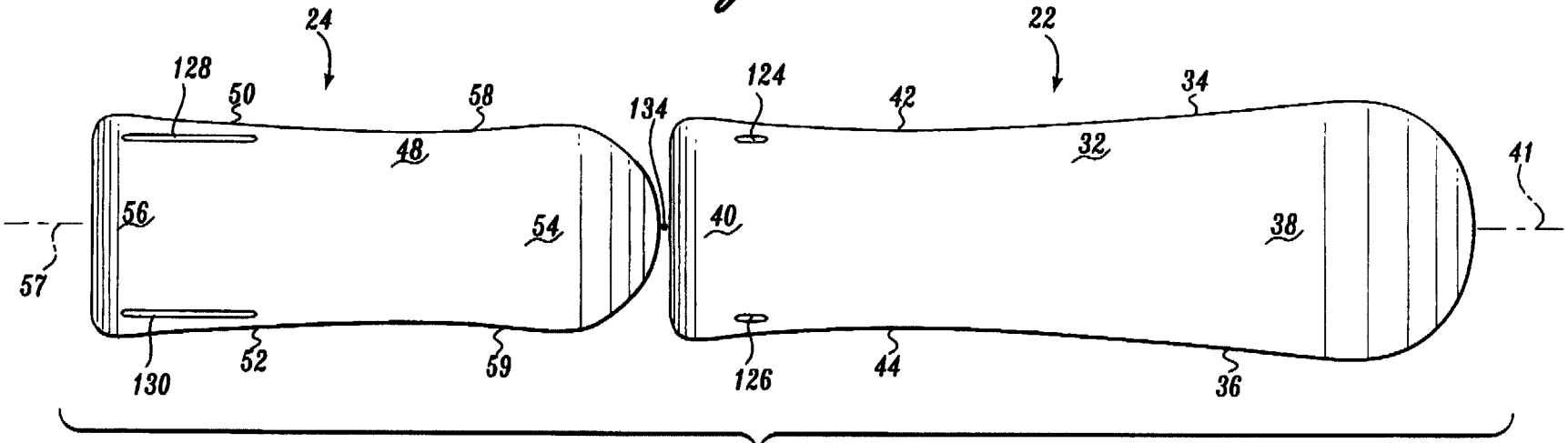
FIG. 6 is a bottom view of the runners for the apparatus of FIG. 1.

Referring now to FIG. 6, a preferred embodiment of the present invention includes two sets of fins, at least one set of each being located on the forward and rear runners 22, 24. A first set of fins 124, 126 is located near the rearward section 40 of the forward runner 22. A second set of fins 128, 130 is located near the rearward section 56 of the rear runner 24. The fins 124, 126, 128, 130 are preferably located at the lowermost portion of the camber of the lower surfaces 32, 48 of the forward and rear runners 22, 24, respectively, so that the fins may maximize their contact with the surface over which the device or snowboard 20 is sliding. It has been found that a preferable length for the front fins 124, 126 is approximately 1 to 2 inches, and a preferable length of the rearward fins 128, 130 is 4 to 7 inches. If longer fins 128, 130 (such as six inches) are used for the rear runner 24, it is preferable to have shorter fins 124, 126 (such as one inch) on the forward runner 22. When selecting suitable lengths for the fins, the ability of the fins to facilitate tracking of the board, assist in turning, braking and stopping of the board should be considered.

In general, the longer the fins 128, 130 on the rear runner 24 the more stable the snowboard 20 when racing. Preferably, a beginning snowboarder will have rear fins 128, 130 of approximately 4 inches in length, and an intermediate will have 5 inches, with advanced snowboarders utilizing rear fins of approximately 6 inches.

In the illustrated embodiment, the fins are relatively thin members. In order to provide fins of added structural integrity the fins can be tapered from their distal end to the end that is adjacent the lower surface of the respective runners. The location and lengths of the fins have been described above with respect to a preferred embodiment. It should be understood that the present invention contemplates location of the fins, sizes of fins, and shapes other than those expressly described above.

As described earlier, both the forward runner 22 and the rear runner 24 have waists 42, 44, 58, 59 near the center of each of the runners. Referring back to FIG. 2, the preferred structure of the forward runner 22 includes a forward girth at its widest point of approximately 10 inches, with a waist of approximately 8 inches. The rearward portion of the forward runner 22 widens back outward to approximately a 9-inch girth. Similarly, the rear runner tapers inwardly at the waist and has a forward girth of approximately 9 inches, a waist of approximately 8 inches, and a rearward girth of approximately 9 inches.

Figure 7:
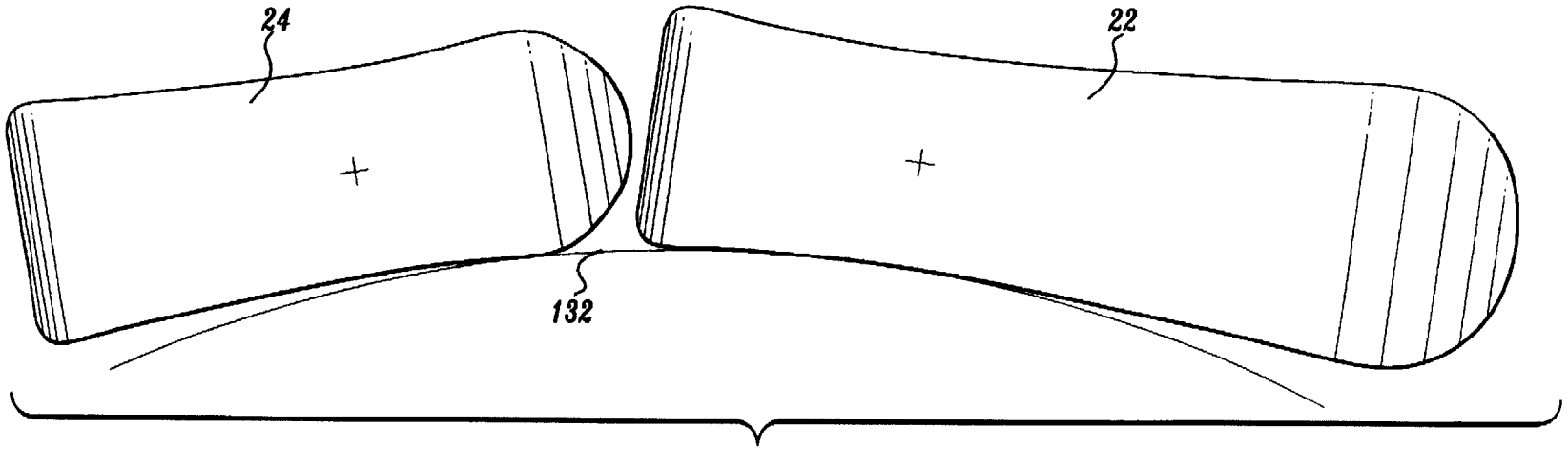
FIG. 7 is a top view of the runners for the two-piece apparatus of FIG. 1, with the linkage removed for detail and the runners shown at the maximum articulation of the device.

As can be seen in FIG. 7, at maximum articulation of the snowboard 20 to the left, an arc 132 is formed from approximately the left waist 44 of the forward runner 22 along the left edge 36 to the rearward section 40 of the forward runner 22 and along the front section 54 of the rear runner 24 along the left edge 52 to approximately the waist 59 on the left side. The radius of the arc 132 is determined by the desired widths of the front section 54 of the rear runner 24, the rearward section 40 of the forward runner 22, the waists for the two runners, and the maximum articulation of the two runners. It is to be understood that variation of one or more of these factors may be necessary so that a substantially smooth arc 132 may be achieved.

The ability of the snowboard 20 to form the arc 132 provides the optimal edge configuration for cornering and maneuvering of a snowboard of any shape or configuration. It is to be understood that if this optimal configuration were offered on both sides of a conventional one-piece snowboard, a bulky and unwieldy snowboard would be the result. In contrast, the preferred orientation of the described two-piece snowboard 20 provides this optimal turning effect on both sides without having to increase the girth of the entire snowboard 20, thus offering a design which optimizes stability as well as maneuverability.

To increase the comfort of a user, the snowboard is designed such that the user is centered on the arc 132 when a turn is implemented. Preferably, the forward shaft 76 and the rear shaft 90 are mounted on portions of the forward runner 22 and rear runner 24, respectively, at points which are equidistant from a hypothetical point 134 lying halfway between the forward runner 22 and the rear runner 24. Likewise, the forward and rear platforms 28, 29 are preferably spaced equidistant from this center point 134. In this manner, the snowboard 20 provides a "centered" feel for a user. Preferably, the focus for the arc 132 will be located on a line which extends between the intersections of the longitudinal axes 41, 57 of the runners 22, 24 when the snowboard 20 is at the maximum articulation and through this arbitrary point 134. Each of these centering features gives the best "feel" and balance to a user when operating the snowboard and particularly when implementing a turn. It should be understood that "feel" and balance for a user can be subjective and therefore it should be understood that the distance between forward shaft 76 and rear shaft 90 can vary, as well as their location along the length of the respective runners. In addition, the location and size of formed arc 132 along the length of snowboard 20 may vary depending on preferred performance criteria.

While this invention has been described in detail with particular reference to preferred embodiments thereof, it will be understood that the variations and modifications can be affected within the spirit and scope of the invention as described hereinbefore and as defined in the appended claims. For example, the present aspects as described above may be incorporated in any device for sliding over a surface, including, but not limited to, a skate board, a water-ski, or a surfboard.

The embodiments of the invention in which an exclusive property or privilege is claimed are defined as follows:

1. An apparatus for sliding on a surface comprising:

a forward runner defining right and left edges, front, rearward and central sections, an upper surface, and an opposing lower surface, the width of the central section being less than the width of both the front section and rearward section, a rear runner defining left and right edges, front, rearward and central sections, an upper surface, and an opposing lower surface, the width of the central section being less than the width of both front section and rearward section, and a linkage for connecting the forward runner to the rear runner, such that the forward runner and the rear runner lie substantially in a plane and such that the front section of the rear runner is proximal to the rearward section of the forward runner, the linkage being configured such that the linkage maintains a distance between the forward and rear runners, but allows articulation of the two runners relative to one another to define an inside articulation of the forward and rear runners such that an inside angle formed by the longitudinal axis of the forward runner and the longitudinal axis of the rear runner is acute, and wherein the rear portion of the left edge of the forward runner and the forward portion of the left edge of the rear runner form a substantially smooth arc.

2. The apparatus of claim 2, wherein the linkage defines a maximum inside articulation of the forward runner relative to the rear runner, and wherein the arc is formed at the maximum inside articulation.

3. The apparatus of claim 1, wherein the substantially smooth arc extends along the inside edge of the forward runner from approximately the central section of the forward runner to the rear section of the forward runner and continues to extend along the inside edge of the rear runner from approximately the front section of the rear runner to the central section of the rear runner.

4. The apparatus of claim 3, wherein the linkage defines a maximum inside articulation of the forward runner relative to the rear runner, and wherein the arc is formed at the maximum inside articulation.

5. The apparatus of claim 2, further comprising a fin located on the lower surface of the forward runner.

6. The apparatus of claim 2, further comprising two fins on the lower surface of the forward runner, the fins located on opposite sides of the lower surface of the forward runner in the rear section of the forward runner.

7. The apparatus of claim 2, wherein the linkage is connected to the forward runner at substantially one location, and is connected to the rearward runner at substantially a second location, and wherein a midpoint between the first location and the second location lies substantially halfway between the forward runner and the rear runner.

8. The apparatus of claim 7, wherein the linkage is configured to define a maximum inside articulation of the forward and rear runners such that an inside angle formed by the longitudinal axis of the forward runner and the longitudinal axis of the rear runner is acute, and wherein the rear portion of the left edge of the forward runner and the forward portion of the left edge of the rear runner form a substantially smooth arc.

9. The apparatus of claim 8, wherein the focus of an arc lies on a line which extends through the midpoint and the intersection of the longitudinal axes of the forward and rear runners at the inside articulation.

10. An apparatus for sliding on a surface comprising:

a forward runner defining right and left edges, front, rearward, and central sections, an upper surface, and an opposing lower surface;

a rear runner defining right and left edges, front, rearward, and central sections, an upper surface, and an opposing lower surface;

a midpoint located substantially halfway between the forward runner and the rear runner; and a linkage for connecting the forward runner to the rear runner, such that the forward runner and the rear runner lie substantially in a plane and such that the front section of the rear runner is proximal to the rearward section of the forward runner, the linkage being configured such that the linkage maintains a distance between the forward and rear-runners, but allows articulation of the two runners relative to one another, the linkage being connected to the forward runner at substantially one location, and being connected to the rearward runner at substantially a second location, and wherein a midpoint between the first location and the second location lies substantially at the midpoint, the linkage being configured to define a maximum inside articulation of the forward and rear runners such that an inside angle formed by the longitudinal axis of the forward runner and the longitudinal axis of the rear runner is acute, and wherein the rear portion of the left edge of the forward runner and the forward portion of the left edge of the rear runner form a substantially smooth arc at the maximum articulation.

11. The apparatus of claim 10, wherein the focus of the arc lies on a line which extends through the midpoint and the intersection of the longitudinal axes of the forward and rear runners at the inside articulation.

12. The apparatus of claim 11, wherein the width of the central section of the rear runner is less than the width of both the front section and the rearward section of the rear runner and wherein the width of the central section of the forward runner is less than the width of both the front section and the rearward section of the forward runner.

13. The apparatus of claim 12, wherein the substantially smooth arc extends from approximately the central section of the forward runner to the rear section of the forward runner and continues to extend from approximately the front section of the rear runner to the central section of the rear runner.

* * * * *

UNITED STATES PATENT AND TRADEMARK OFFICE

CERTIFICATE OF CORRECTION

PATENT NO. : 5,799,956
DATED : September 1, 1998
INVENTOR(S) : W.D. Shannon

It is certified that error appears in the above-identified patent and that said Letters Patent is hereby corrected as shown below:

| COLUMN | LINE | |
|---|---|---|
| [56] Pg. 1, col. 2 | Refs. Cited (Foreign patents) | insert the following foreign references:<br>--2 665 642 2/1992 France<br>2 432 876 3/1990 France<br>DE 28 44 408 A1 6/1980 Germany-- |
| 7 (Claim 2, | 29 line 1) | "2" should read --1-- |
| 7 (Claim 5, | 44 line 1) | "2" should read --1-- |
| 7 (Claim 6, | 46 line 1) | "2" should read --1-- |
| 7 (Claim 7, | 50 line 1) | "2" should read --1-- |

UNITED STATES PATENT AND TRADEMARK OFFICE

CERTIFICATE OF CORRECTION

PATENT NO. : 5,799,956

DATED : September 1, 1998

INVENTOR(S) : W.D. Shannon

It is certified that error appears in the above-identified patent and that said Letters Patent is hereby corrected as shown below:

| COLUMN | LINE | |
|---|---|---|
| 8 (Claim 10, | 26 line 16) | "rear-runners" should read --rear runners-- |

Signed and Sealed this

Thirtieth Day of March, 1999

*Attest:*

*Attesting Officer*

Q. TODD DICKINSON

*Acting Commissioner of Patents and Trademarks*